US008113128B2

(12) United States Patent
Lee

(10) Patent No.: US 8,113,128 B2
(45) Date of Patent: Feb. 14, 2012

(54) FOLDING TABLE ASSEMBLY

(75) Inventor: Freddy T. Lee, Boynton Beach, FL (US)

(73) Assignee: Lee Ideas, Inc., Boynton Beach, FL (US)

( * ) Notice: Subject to any disclaimer, the term of this patent is extended or adjusted under 35 U.S.C. 154(b) by 226 days.

(21) Appl. No.: 12/573,941

(22) Filed: Oct. 6, 2009

(65) Prior Publication Data

US 2011/0017103 A1 Jan. 27, 2011

Related U.S. Application Data

(60) Provisional application No. 61/213,841, filed on Jul. 21, 2009.

(51) Int. Cl.
*A47B 23/00* (2006.01)

(52) U.S. Cl. ..... 108/42; 108/49; 108/152; 297/160

(58) Field of Classification Search ..... 297/147, 297/160, 161, 162; 108/152, 42, 44, 48, 108/49; 248/587, 595, 123.11, 125.8, 205.1, 248/228.7

See application file for complete search history.

(56) References Cited

U.S. PATENT DOCUMENTS

| | | | | | |
|---|---|---|---|---|---|
| 1,809,866 | A | * | 6/1931 | Riesche | 108/38 |
| 1,890,102 | A | * | 12/1932 | Urquhart | 297/411.23 |
| 2,034,835 | A | * | 3/1936 | Dante | 297/161 |
| 2,635,680 | A | | 4/1953 | Zentmire | |
| 3,054,122 | A | * | 9/1962 | Sarkus | 108/49 |
| 3,301,406 | A | * | 1/1967 | Scott | 108/97 |
| 3,583,760 | A | * | 6/1971 | McGregor | 297/145 |
| 3,586,368 | A | | 6/1971 | Guild | |
| 3,632,161 | A | * | 1/1972 | Arfaras et al. | 297/145 |
| 3,717,375 | A | * | 2/1973 | Slobodan | 297/162 |
| 4,341,418 | A | * | 7/1982 | Chappell | 297/144 |
| 4,575,149 | A | * | 3/1986 | Forestal et al. | 297/145 |
| 4,829,910 | A | * | 5/1989 | Lirette | 108/35 |
| 4,834,449 | A | * | 5/1989 | Engelman | 297/145 |
| 4,909,158 | A | | 3/1990 | Sorensen | |
| 4,998,484 | A | * | 3/1991 | Groetzinger | 108/42 |
| 5,022,617 | A | * | 6/1991 | Henderson | 248/125.8 |
| 5,035,464 | A | | 7/1991 | Spallholtz | |
| 5,129,702 | A | * | 7/1992 | Ervin | 297/144 |
| 5,293,825 | A | * | 3/1994 | Cauffiel | 108/49 |
| 5,317,977 | A | * | 6/1994 | Omessi | 108/97 |
| 5,460,101 | A | * | 10/1995 | Garbutt, Sr. | 108/42 |
| 5,564,779 | A | | 10/1996 | Tolbert et al. | |
| 5,893,607 | A | * | 4/1999 | Trimnell | 297/170 |
| 6,142,559 | A | * | 11/2000 | Sorel et al. | 297/135 |
| 6,338,302 | B1 | * | 1/2002 | Montagner | 108/152 |
| 6,523,903 | B1 | * | 2/2003 | Rabenhorst | 297/411.32 |
| 6,691,627 | B2 | | 2/2004 | Einsel et al. | |
| 6,793,281 | B2 | * | 9/2004 | Duerr et al. | 297/147 |
| 6,899,386 | B2 | | 5/2005 | Anton | |
| 7,509,696 | B2 | * | 3/2009 | Soto et al. | 108/49 |
| 7,721,657 | B2 | * | 5/2010 | Carstensen | 108/42 |

* cited by examiner

*Primary Examiner* — Jose V Chen

(74) *Attorney, Agent, or Firm* — Roylance, Abrams, Berdo & Goodman, L.L.P.

(57) ABSTRACT

A table assembly is provided for removably coupling to a chair or couch or other furniture with an opening from the floor, such as a bed or cabinet, to provide a horizontal table surface. The table assembly is removably coupled to the chair or couch by a spring engaging the bottom surface of the chair or couch or other coupling mechanism for removably coupling the table assembly to the chair or couch. The table assembly includes a base for engaging the floor and a table leaf that can be pivoted from a retracted position to an extended horizontal position. A latching mechanism is provided for retaining the table leaf in the upright extended position.

20 Claims, 12 Drawing Sheets

FOLDING TABLE ASSEMBLY

CROSS-REFERENCE TO RELATED APPLICATION

This application claims priority under 35 U.S.C. §119(e) of U.S. provisional application Ser. No. 61/213,841, filed Jul. 21, 2009, which is hereby incorporated by reference in its entirety.

FIELD OF THE INVENTION

The present invention is directed to a folding assembly for attaching to a furniture structure such as a chair or couch. The invention is particularly directed to a folding table assembly that can be easily attached to and removed from a chair or couch.

BACKGROUND OF THE INVENTION

Various folding table device have been used for temporary use in association with a chair or other seating device. Folding chairs are also known in the art that can be used in association with a folding table or other horizontal support surface.

One example of a prior folding chair and table assembly is disclosed in U.S. Pat. No. 6,691,627 to Einsel et al. The device includes an attachable table for a lawn chair with a hinged table top and adjustable leg. The table top can attach to a chair with two loop and pile fastener strips that pass through slots in the end of the table top. The leg adjusts to the height of the lawn chair by sliding two slotted legs pieces together and then tightening a wing nut.

Another table attachment is disclosed in U.S. Pat. No. 2,635,680 to Zentmire. This device includes a slide plate engaged in a guide way and slides on lower flanges. The guide way is attached to the underside of the seat frame of the chair. A standard extends upwardly from the sliding plate. A table is attached to the top end of the standard. The device can be folded to a compact size to be able to slide under the chair along the guide way.

Still another folding table arrangement is disclosed in U.S. Pat. No. 3,583,760 to McGregor. This device includes a table-holding frame positioned along the side of a vehicle seat where the table is movable in a fore and aft direction. A hinge connects the table to the holding frame. The table can be lifted to a vertical position and rotated downward to a horizontal position.

Another device is disclosed in U.S. Pat. No. 3,586,368 to Guild. This device includes a tray pivotably connected to a mounting plate having spring clamps for mounting the plate and tray to the arm of a chair. The tray is mounted to the plate at an off center pivot to allow the tray to swing over the seat.

Another folding chair and tray assembly is disclosed in U.S. Pat. No. 6,899,386 to Anton. This device includes a removable table top for use with a folding chair. The chair has a frame coupled to the platform with connectors and a chair bracket. The platform can be converted from a folded mode to an unfolded mode.

One example of a collapsible table is disclosed in U.S. Pat. No. 5,022,617 to Henderson. The table is designed for supporting clothing and includes a stand with a tubular telescoping post. The upper end of the post has an arm the can be pivoted from a folded vertical position to a horizontal position for use.

While the above devices have generally been suitable for the intended use, there is a continuing need for improved folding table assemblies.

SUMMARY OF THE INVENTION

The present invention is directed to a folding table assembly that can be folded from a stored position and an unfolded position for use. The invention is particularly directed to a folding table assembly that can be attached to and removed from a chair, couch, or other furniture device such as a bed or cabinet.

Accordingly and primary aspect of the invention is provide a folding table that can be attached to a chair or couch without modifying the chair or couch. The folding table of the invention is foldable to a compact, low profile shape that stands next to the chair in an upright position.

Another aspect of the invention is to provide a folding table that can be coupled to the chair or couch and folded to a vertical, compact and slim construction when not in use. The table can then be unfolded to a horizontal position for use.

The folding table assembly of the invention has a slim, narrow construction when in the stored position. The table assembly includes a vertical base and a table leaf that fold flat against the base when not in use. The table leaf can then be folded to a horizontal position for use. The table assembly includes a base having an upright orientation that can be positioned along the side of the chair. A hinged table leaf is coupled to the base to pivot between a vertical retracted position and a horizontal position. The bottom end of the base has a coupling assembly for removably attaching the table assembly to the bottom of the chair. In one embodiment the coupling mechanism is a spring arm that extends outwardly from the base and has an outer end that engages the bottom of the chair while the base engages the floor.

The table leaf can be moved from the vertical position to the horizontal position by various mechanical arrangements. The table leaf preferably includes a latching or locking mechanism to hold the table leaf in the horizontal position. The latching mechanism can be a slot with a recess for receiving a pin on the table leaf.

The various aspects of the invention are basically attained by providing a folding table assembly including a base having a vertical dimension with a top end and bottom end for engaging the floor and supporting the base. A table leaf is coupled to the base and is movable between and retracted position lying substantially parallel to the base and an extended horizontal position substantially perpendicular to the base. A coupling mechanism is provided for coupling the base to a chair or couch.

The aspects of the invention are also attained by providing a retractable table assembly for removably coupling to a chair or table where the assembly includes a table base having a substantially planar configuration with a floor-engaging bottom end, and first side, a second side and top end. A table leaf is coupled to the base and is movable between a retracted position substantially parallel to and against the side of the base and an extended position substantially perpendicular to the first side of the base. A latching mechanism is provided for retaining the table leaf in the extended position. A coupling mechanism is included having a first end coupled to the base and a second end removably coupled to the bottom face of the chair or couch.

The various aspects of the invention are further attained by providing a folding table assembly for removably coupling with a furniture support having a downwardly facing surface. A table base has a substantially planar configuration with a bottom floor engaging end and a top end. A table leaf is pivotally coupled to the base and is movable between a retracted position lying substantially parallel against the base and an extended position substantially perpendicular to a longitudinal dimension of the base. A coupling mechanism has a first end coupled to the base and second end engaging the bottom surface of the furniture support. The coupling mechanism is adapted for removably coupling the base to the furniture support.

These and other aspects of the invention will become apparent from the following annexed drawings and the detailed description of the invention which disclose various embodiments of the invention.

BRIEF DESCRIPTION OF THE DRAWINGS

The following is a brief description of the drawings in which.

DETAILED DESCRIPTION OF THE INVENTION

The present invention is directed to a table assembly that can be easily coupled to a chair, couch or other furniture item without altering or damaging the chair or couch. The invention is particularly directed to a folding table assembly that can be removably coupled to and supported by a chair or couch along the side and where the table can be folded from a retracted position to an extended position.

Figure 1:
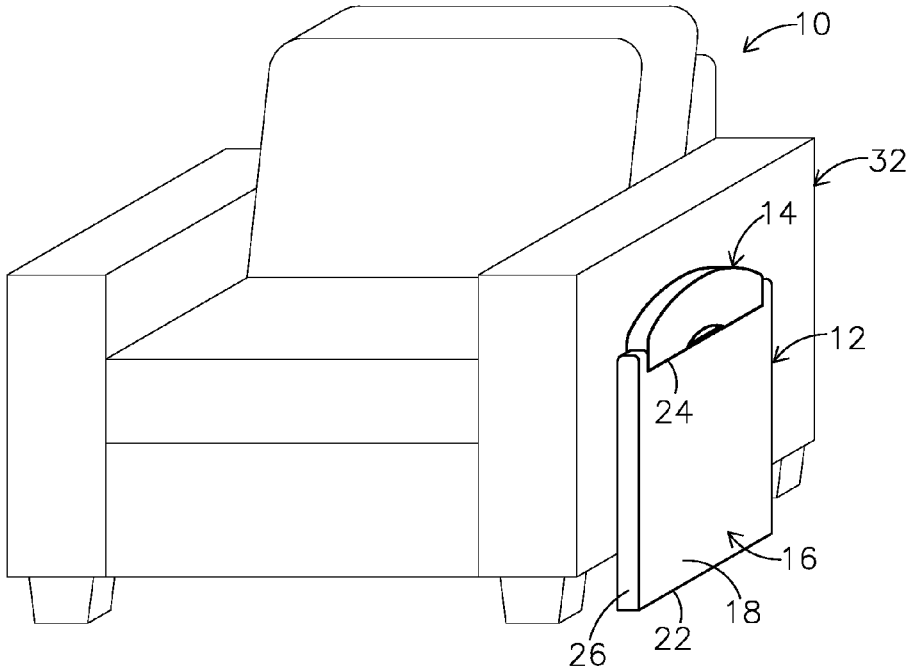
FIG. 1 is a perspective view of the folding table assembly in the folded position in one embodiment of the invention.
Figure 2:
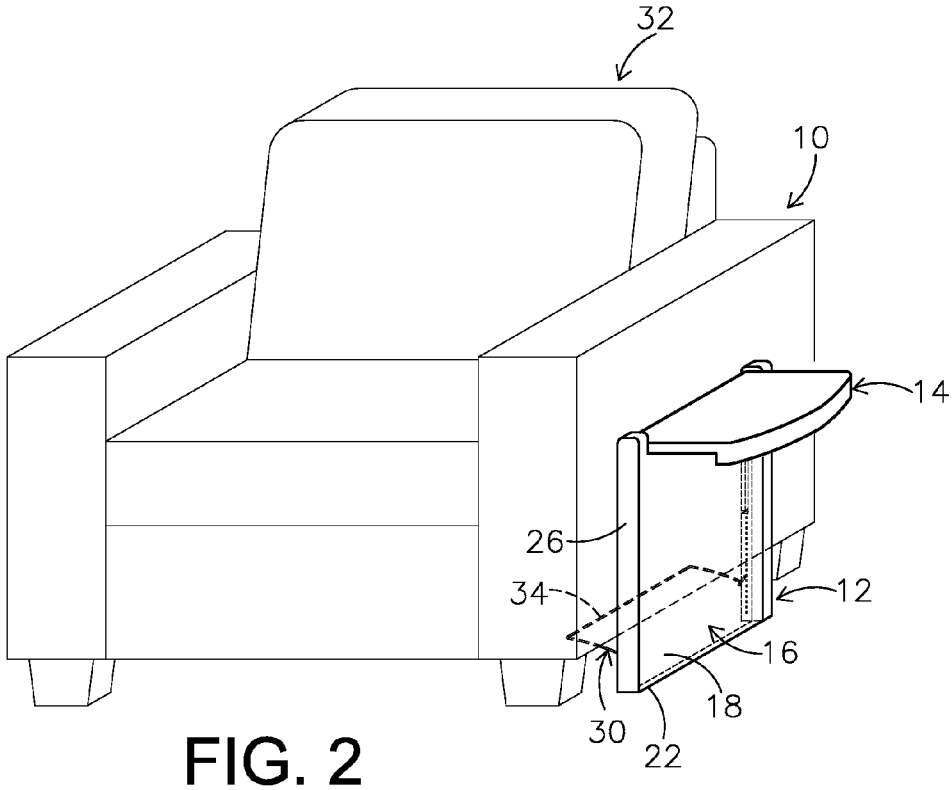
FIG. 2 is a perspective view of the folding table assembly of FIG. 1 in the extended position.
Figure 3:
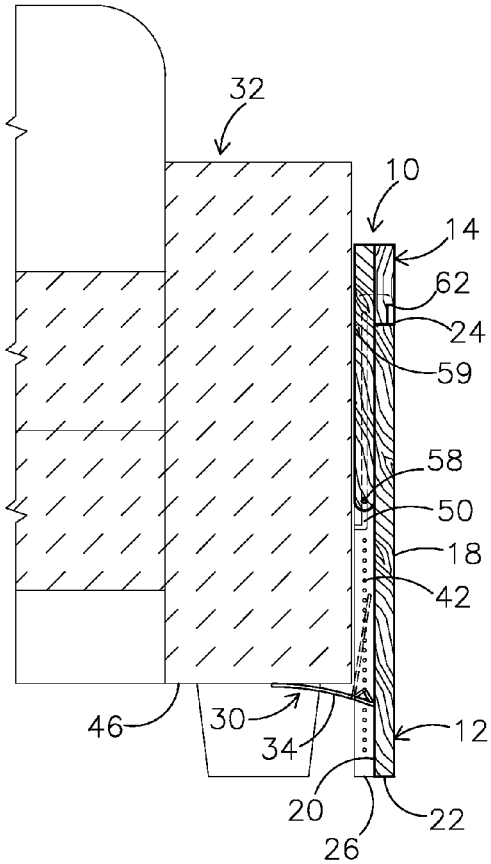
FIG. 3 is a cross-sectional end view of the table assembly in the folded position.
Figure 4:
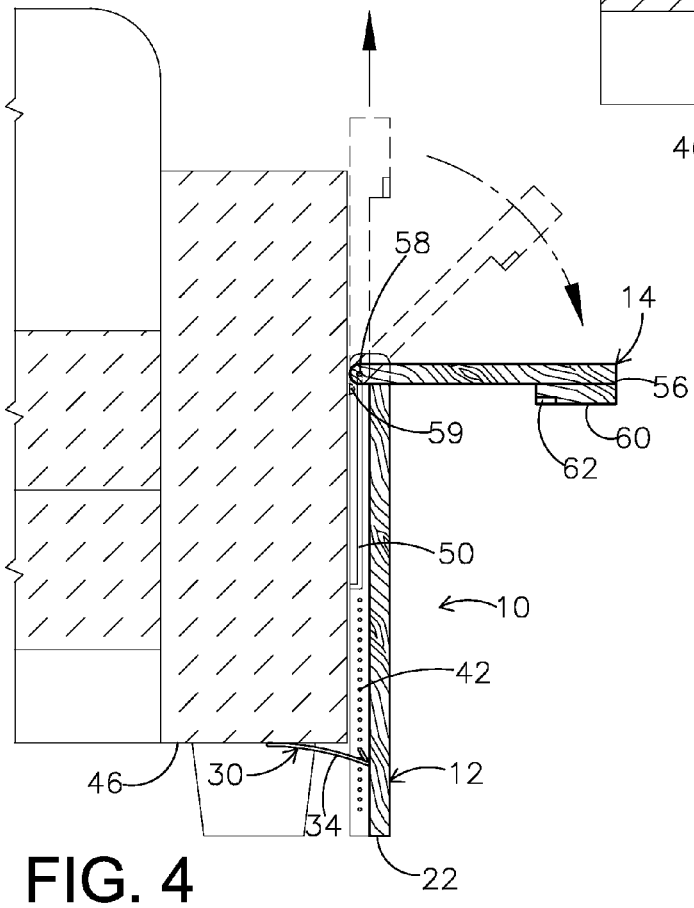
FIG. 4 is a cross-sectional end view of the table assembly in the extended position.
Figure 5:
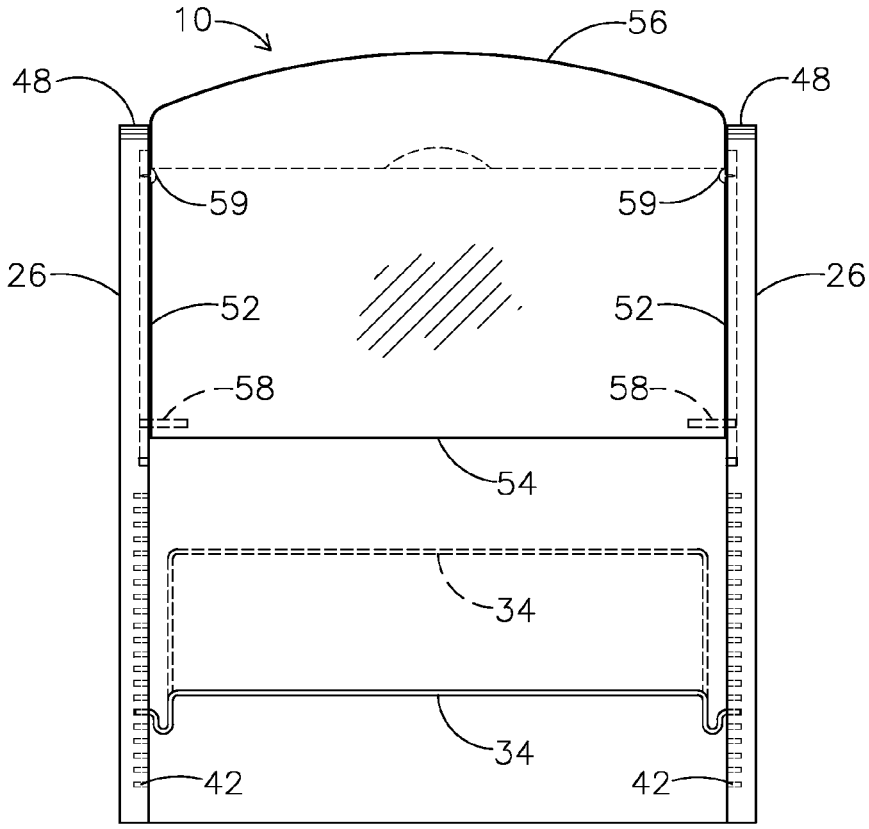
FIG. 5 is a rear view of the table assembly.
Figure 6:
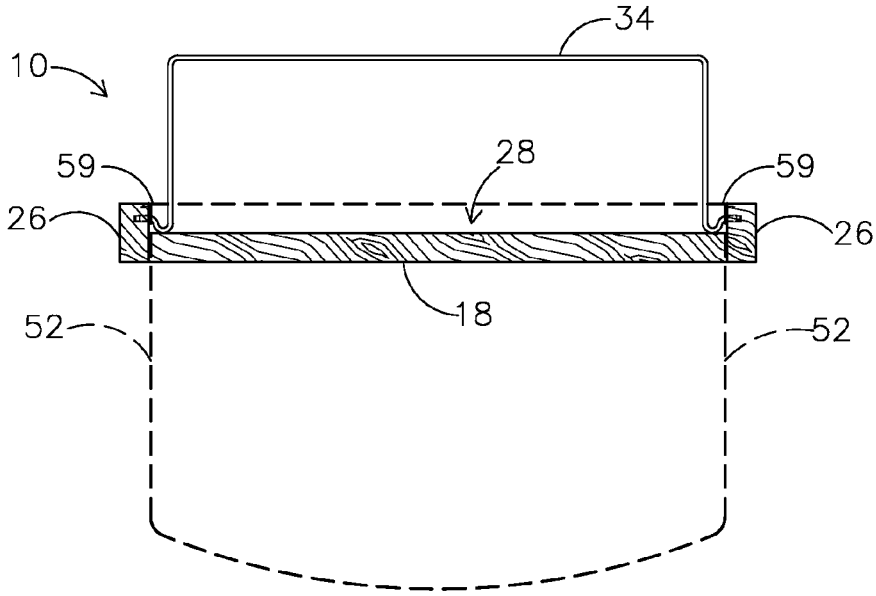
FIG. 6 is a top view in partial cross-section of the table assembly.

Referring to the drawings, the invention is directed to a folding table assembly 10 having a base 12 and a table leaf 14. In the embodiment of FIGS. 1-6, base 12 has a substantially planar configuration and is constructed to be oriented in a substantially upright position as shown in FIG. 1. Base 12 in the embodiment illustrated has a panel 16 with an outer face 18 and an inner face 20 as shown in FIGS. 3 and 4. Panel 16 has a bottom edge 22 for engaging the floor and a top end 24.

Referring to FIGS. 3 and 4, base 12 includes end rails 26 that extend the full length of panel 16. As shown in FIGS. 3 and 4, end rails 26 are oriented along the outer side edges of panel 16 and extend from the inner face 20. End rails 26 and panel 16 define an internal cavity 28 for table leaf 14 when table leaf 14 is in the retracted and stored position as shown in FIG. 3.

Base 12 further includes a coupling mechanism 30 for coupling table assembly 10 to a chair 32 or other furniture item. In a preferred embodiment, the coupling mechanism engages the bottom or underside of the chair to hold the base in an upright position without the need for multiple legs or supports. In the embodiment shown, coupling mechanism 30 is a spring 34 that is coupled to base 12 for coupling table assembly 10 to chair 32 and retaining table assembly 10 in an upright position. In one embodiment, spring 34 shown in FIG. 7 has a pair of arms 36, and outer end member 38 extending between the arms 36. Outwardly extending legs 40 extend from an inner end of the arms 36 for coupling with the rails 26 of base 12.

Figure 7:
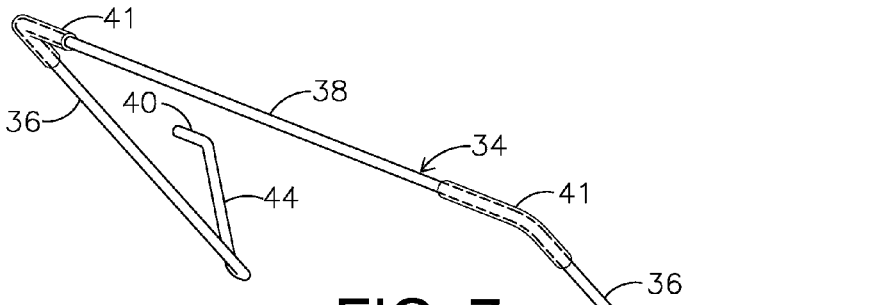
FIG. 7 is a perspective view of the spring member in one embodiment.

Rails 26 as shown in FIGS. 3 and 4 include a plurality of aligned holes 42 for receiving legs 40 of spring 34. Holes 42 are spaced apart and provide vertical adjustment of spring 34 to accommodate the chair 32 and space between the underside of the chair and the floor. As shown in FIG. 7, arms 36 have an angled portion 44 to engage panel 16 when spring 34 is pivoted downwardly and to bias legs 40 in an upward direction. Legs 40 and outer end member 38 of spring 34 are spring biased to engage a bottom surface 46 of chair 32 with a sufficient force to retain table assembly 10 in an upright position as shown in the drawings. Spring 34 can be adjusted to a selected height by bending legs 40 inwardly to release the legs from a respective hole 42 in end rails 26 and position the legs 40 in a desired hole. Spring arms 36 are preferably biased in an upward direction as shown by the phantom lines in FIGS. 3 and 5. Spring arms 36 and end member 38 are manually flexed downwardly to the position shown in FIGS. 2, 3 and 5 and positioned to engage the bottom of the chair 32 with sufficient force to retain table assembly in an upright position. Legs 40 of spring 34 can pivot within the respective holes in end rails 22 so that spring 34 can pivot upwardly against the inner surface of panel 18 when not in use as shown in phantom lines in FIG. 5. In one embodiment, spring 34 can have slip-resistant members or a coating of slip resistant plastic material 41 that engage the bottom surface of the chair or other support to resist separation of the spring from the chair.

Table leaf 14 is coupled to base 12 in a manner to retract when not in use and to be extended in a horizontal position for use in supporting various objects. In the embodiment shown, table leaf 14 has a dimension to fit within cavity 28 between end rails 26. End rails 26 have a top end 48 that extends above the top edge of panel 16. End rails have a longitudinal slot 50 that face inwardly into the cavity defined by the end rails 26 and panel 16.

Table leaf 14 has side edges 52, an inner edge 54, and an outer edge 56. Side edges 52 include a hinge pin 58 adjacent the inner edge 54 and extend outwardly toward end rails 26. Hinge pins 58 are received in the slot 50 to enable table leaf 14 to slide between a retracted position shown in FIGS. 1 and 3 to an extended position shown in FIGS. 2 and 4. As shown in FIG. 4, slots 50 extend along the length of end rails 26 above the top edge of panel 16 to enable table leaf 14 to pivot downwardly to a horizontal position shown in FIG. 4 and engage the top end of panel 16. As shown in FIGS. 3 and 4, a stop member 59 extends inwardly from each side rail adjacent the rear face to hold the table leaf 14 in the retracted position and prevent the table leaf from falling backwards when separated from the furniture. The stop member in the embodiment illustrated is a pin that engages the top side of the table leaf when the table leaf slides into the retracted position.

The top end of panel 16 defines a support to support the table leaf 14 in a horizontal position and in a position substantially perpendicular to the plane of base 12. The slot 50 terminates at a point above the top end of panel 16 a distance so that travel of pins 58 stops at a point to hold table leaf 14 in a horizontal position when table leaf 14 pivots downward into contact with the top end 24 of panel 16. The top end 51 of slot 50 and top end 24 of panel 16 define a stop mechanism to hold the table leaf 14 in a horizontal position perpendicular to the plane of the panel 16.

In the embodiment shown in FIGS. 1-6, table leaf 14 has a rounded outer edge and a block 60 adjacent the outer edge of table leaf 14. Block 60 has a thickness to lie in the same plane as the outer face of base 12 when table leaf 14 is in the retracted position shown in FIG. 1 to provide an aesthetic uniform appearance. Block 60 can include a finger hole 62 or other gripping member to allow the user to easily grip the table leaf and lift the table leaf with respect to the base 12 upwardly and to pivot the table leaf downwardly to the operating position.

Figure 8:
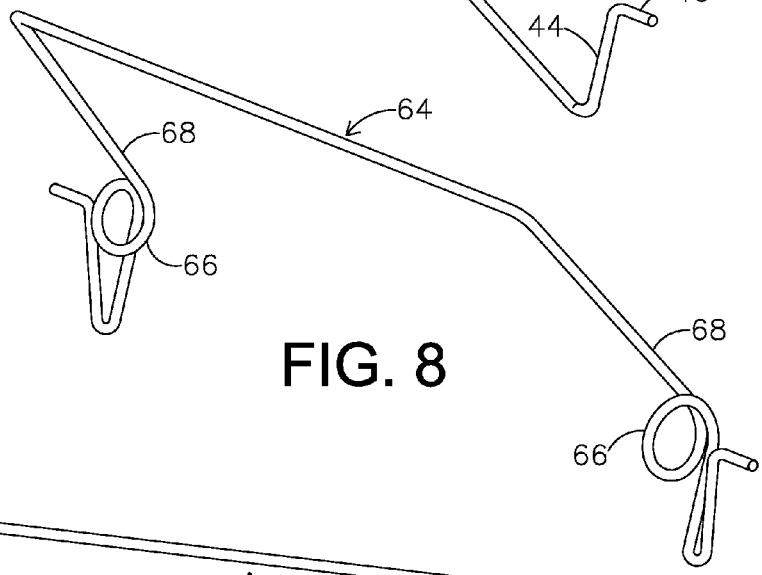
FIG. 8 is a perspective view of the spring member in a second embodiment.
Figure 9:
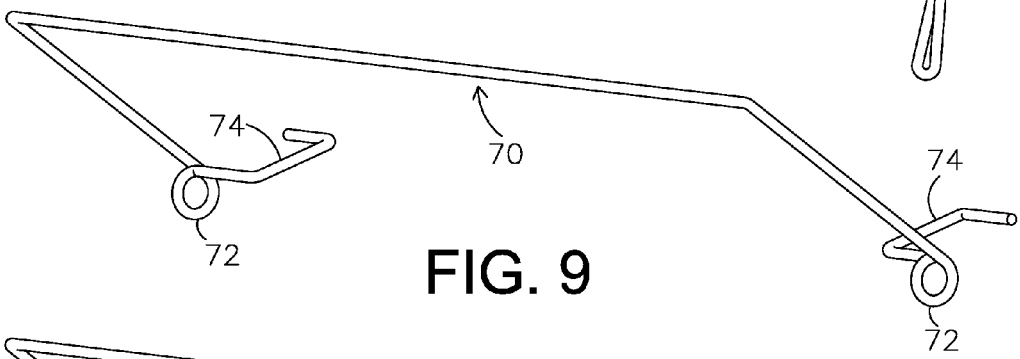
FIG. 9 is a perspective view of the spring member in a third embodiment.
Figure 10:
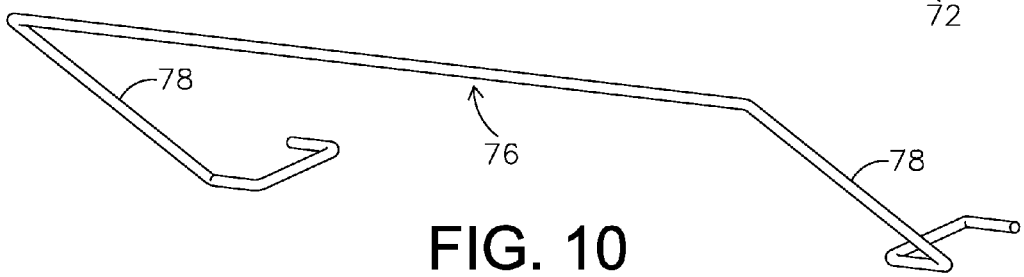
FIG. 10 is a perspective view of the spring member in a fourth embodiment.
Figure 11:
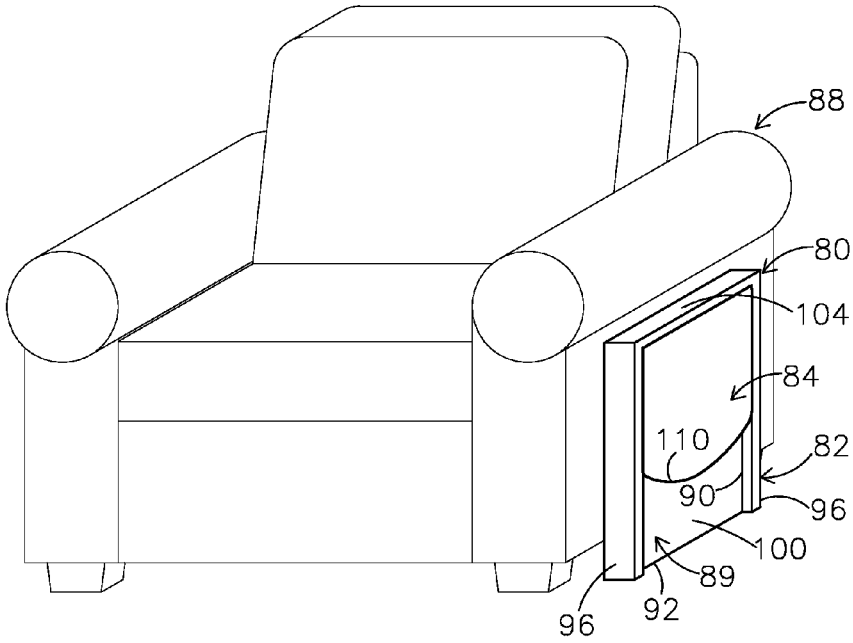
FIG. 11 is a perspective view of the table assembly in a second embodiment showing the table in the folded position.
Figure 12:
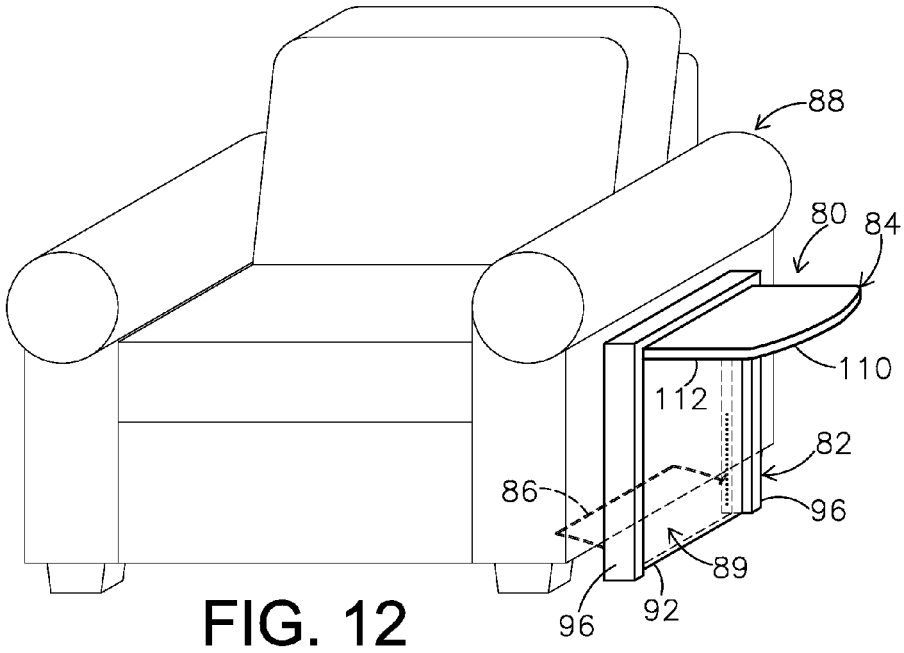
FIG. 12 is a perspective view of the embodiment of FIG. 11 showing the table in the extended position.

Spring 34 is constructed of a suitable spring steel material to provide a sufficient biasing force to engage the bottom surface of chair 32 to retain table assembly 10 in an upright position. Various designs of a suitable spring can be constructed for retaining the table assembly in the upright position. In an alternative embodiment shown in FIG. 8, spring 64 has a circular loop 66 and a downwardly extending leg portion 68 to engage the inner surface of panel 16. FIG. 9 shows an alternative embodiment where spring 70 includes a loop 72 and leg portions 74 that extend inwardly from the loop 72. FIG. 10 shows another embodiment of a spring 76 having an inwardly extending leg portion 78 to engage the outer surface of end rails 26.

In a second embodiment of the invention shown in FIGS. 11-17, folding table assembly 80 includes a base 82 and table leaf 84. Base 82 includes a spring 86 which serves as a coupling member for coupling table assembly 80 to a chair 88 in a manner substantially the same as in the embodiment of FIGS. 1-10. Spring 86 in the illustrated embodiment has a construction similar to the embodiment of FIG. 8. Spring 86 is spring biased in an upward direction to engage the bottom surface of the chair 88 as in the previous embodiment with sufficient force to hold table assembly 80 in an upright position.

Figure 13:
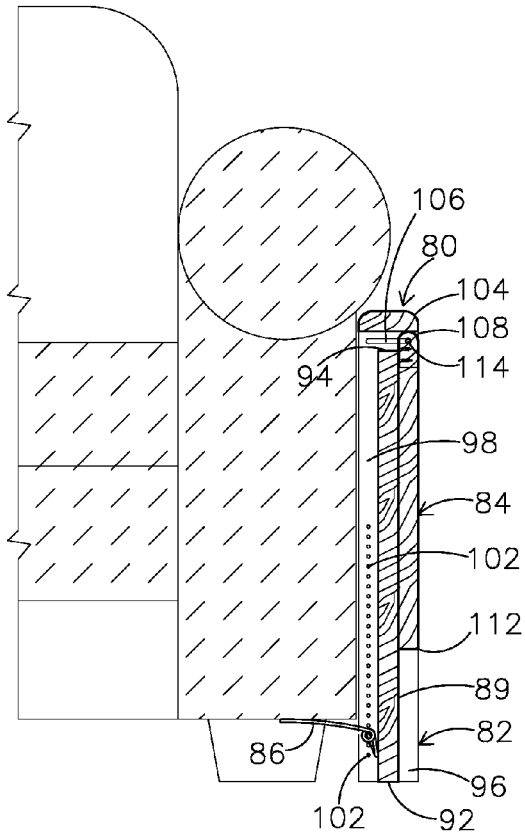
FIG. 13 is a cross-sectional end view of the embodiment of FIG. 11 showing the table in the folded position.
Figure 14:
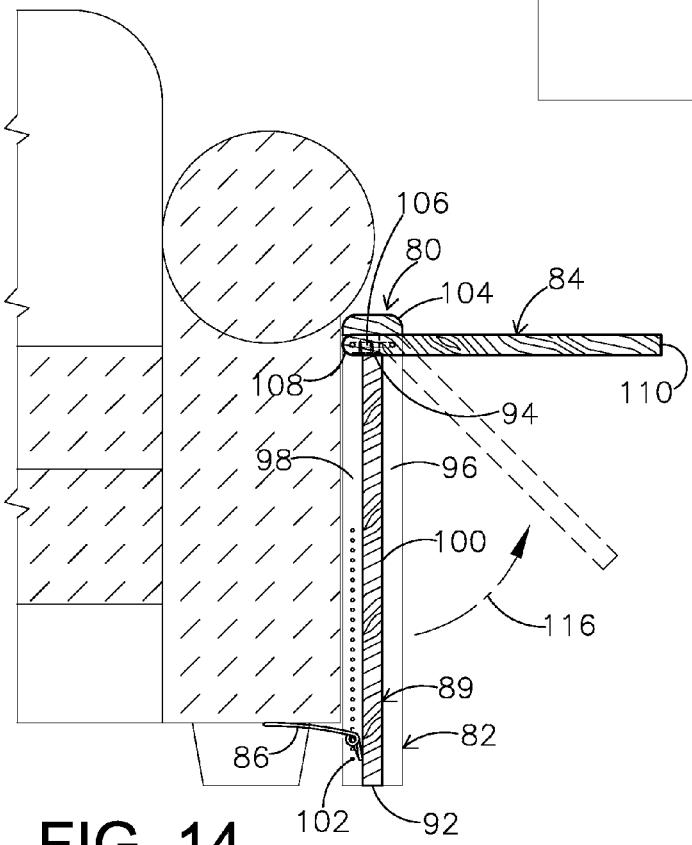
FIG. 14 is a cross-sectional end view showing the table in the extended position.
Figure 15:
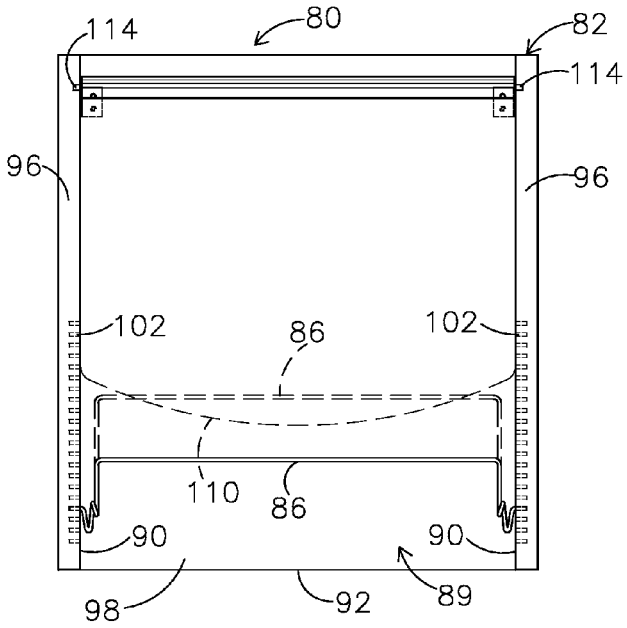
FIG. 15 is a rear view of the table assembly of FIG. 11.
Figure 16:
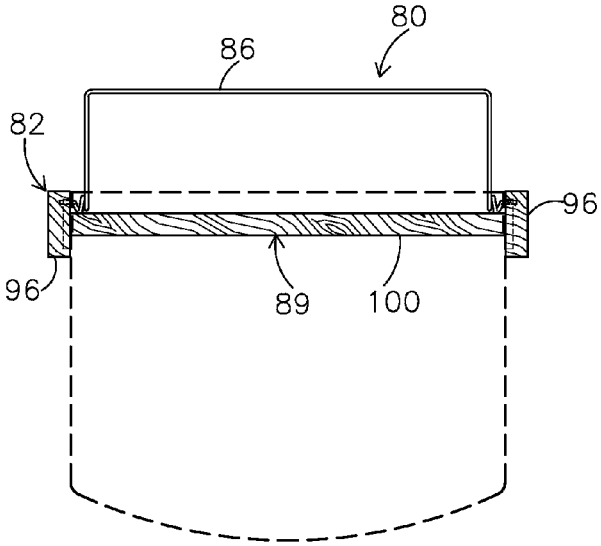
FIG. 16 is a top view of the table assembly of FIG. 11.

Base 82 has a substantially planar dimension with a panel 89 having opposite side edges 90, a bottom edge 92 and a top end 94 shown in FIG. 13. Bottom end 92 has a substantially flat edge to engage the floor or ground. Base 82 includes side rails 96 coupled to side edges 90 of the panel 89 of base 82. In the embodiment illustrated, side rails 96 have a height slightly greater than the height of the panel 89 and a width greater than the width of the panel 89 to extend perpendicular from the inner face and outer face of the panel. The inner surface 98 of side rails 96, as shown in FIG. 14, include a plurality of aligned holes 102 adjacent the inner surface of the panel for adjusting the vertical position of the coupling spring 86 in a manner similar to the previous embodiment.

Base 82 includes a top rail 104 coupled to the upper ends of side rails 96. Side rails 96 have a height greater than the panel 89 so the top rail 104 is spaced from the top edge of the panel 89 as shown in FIG. 13. A transverse slot 106 extends transversely on the inner side of each side rail 96 adjacent the top end and extending transversely through the gap between the top end of panel 89 and the top rail 104.

Table leaf 84 has a planar dimension with an inner edge 108, an outer edge 110 and side edges 112. Side rails 96 have a width to extend from the outer face 100 of panel 89 to define a recessed area sufficient to receive the table leaf 84. As shown in FIG. 13, table leaf 84 has a thickness corresponding to the depth of the recess on the outer face 100 of panel 89.

Table leaf 84 includes an outwardly extending hinge pin 114 extending outwardly from each side edge 112 of panel 89 adjacent the inner edge 108. The hinge pin 114 is received in a respective slot 106 for allowing limited pivoting and sliding movement of table leaf 84 with respect to base 82. Slot 106 is oriented with respect to base 82 to allow table leaf 84 to pivot in a downward position shown in FIG. 13 to a retracted position and to fit within the recess formed by the side rails 96 and top rail 104. Table leaf 84 is pivoted in an upward direction indicated by arrow 116 in FIG. 14 to a horizontal position perpendicular to the plane of base 82. Table leaf 84 then slides along slot 106 inwardly between the gap formed between the top end 94 of panel 89 and the bottom surface of top rail 104 so that the hinge pins 114 slide to the inner end of the respective slot 106 as shown in FIG. 14. In the position shown in FIG. 14, table leaf 84 is retained in the extended position. Table leaf 84 is cantilevered with respect to base 82 by the top surface of table leaf 84 engaging the bottom side of top rail 104 and the inner bottom face of table leaf 84 engaging the top end of panel 89. The hinge pins 114, slot 106, top end 94 of panel 89 and top rail 104 define a support to retain the table leaf in the extended operating position. Table leaf 84 is retracted by pulling the table leaf 84 outwardly with respect to base 82 until the hinge pins 114 reach the outer end of the respective slot 106. At that point, table leaf 84 can be folded downwardly to the retracted position.

Figure 17:
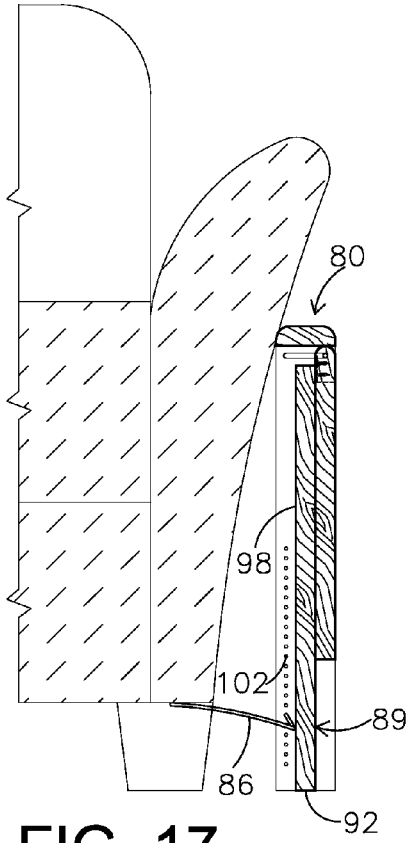
FIG. 17 is a cross-sectional end view of the table assembly of FIG. 11.

As shown in FIG. 17, spring 86 preferably has a length to accommodate for different shapes of the couch or chair while being able to engage the bottom surface of the chair to retain the table assembly 80 in the upright position.

Referring to FIGS. 18-23, another embodiment of table assembly 118 is shown. Table assembly 118 includes a base 120, a table leaf 122 and a coupling spring 124 for coupling table assembly 118 to a chair 126. Spring 124 corresponds to the springs of the previous embodiments of FIG. 9 and FIG. 10 and has an upward biasing force sufficient to engage the bottom surface of chair 126 and retain table assembly 118 in the upright position.

Base 120 in this embodiment includes a pair of side rails 128 oriented in a vertical direction, a bottom rail 130 and a top rail 132 spaced from bottom rail 130 and extending between the opposite side rails 128. Side rails 128 have an inner face 134 with a plurality of aligned holes 136 for receiving the spring 124 in a selected position as in the previous embodiments. Side rails 128, bottom rail 130 and top rail 132 are spaced apart to define an open area 138 having a dimension for receiving the table leaf 122. In the embodiment illustrated, top rail 132 has a width less than the width of side rails 128 and is positioned adjacent an inner side of side rails 128 and base 120.

Figure 22:
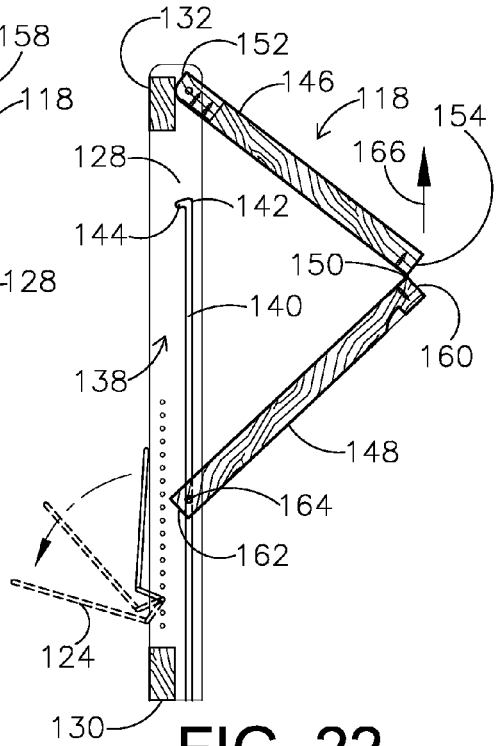
FIG. 22 is a cross-sectional end view of the table assembly of FIG. 18 showing the table in the extended position.

As shown in FIG. 22, each side rail 128 includes a longitudinal slot 140 extending in a vertical direction from the bottom end towards the top end of each side rail 128. The upper end 142 of slot 140 is spaced from the top end of each side rail as shown in FIG. 22. Slot 140 includes a horizontal portion extending perpendicular from the longitudinal dimension of the side rails 128 to define a horizontal latching portion 144.

Table leaf 122 includes a main portion 146 and a supporting leg portion 148 defining a brace. Main portion 146 and leg portion 148 are coupled together by hinge 150. Main portion 146 has an inner edge 152, an outer edge 154 and side edges 156. Side edges 156 include a pin 158 that are received in a respective hole on the inner face of side rails 128 adjacent the top end to allow main portion 146 to pivot between a retracted vertical position shown in FIG. 18 and a horizontal extended position shown in FIG. 19.

Leg portion 148 has a top end 160 coupled to main portion 146 by hinge 150 and a bottom end 162. Bottom end 162 is provided with outwardly extending pins 164 that are received in a respective slot 140.

Figure 18:
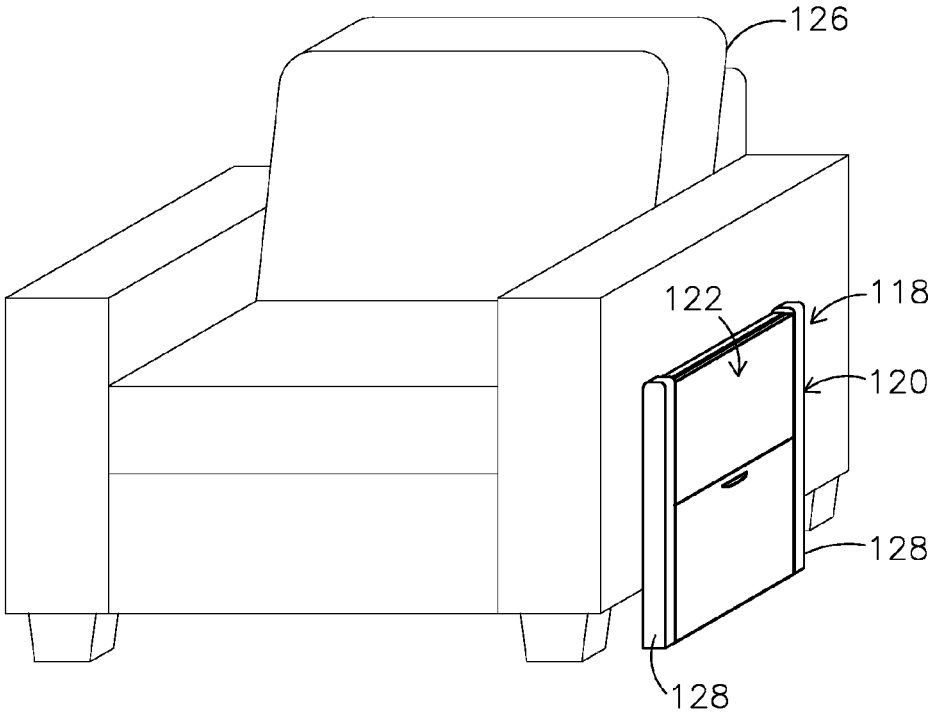
FIG. 18 is a perspective view of the table assembly in a third embodiment.
Figure 19:
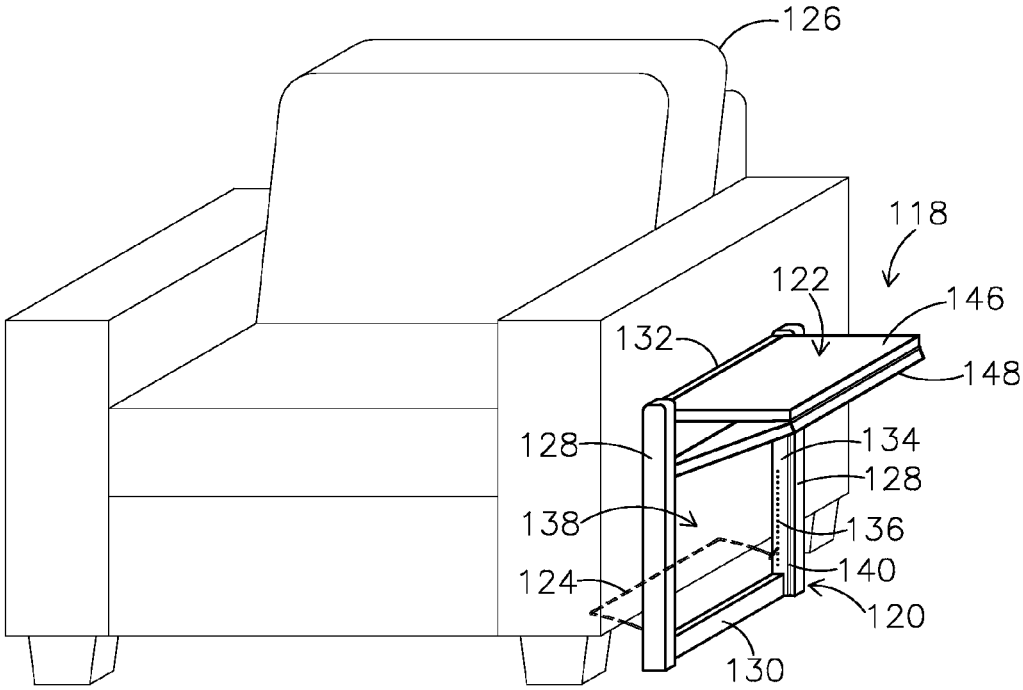
FIG. 19 is a perspective view of the embodiment of FIG. 18 showing the table in the extended position.
Figure 20:
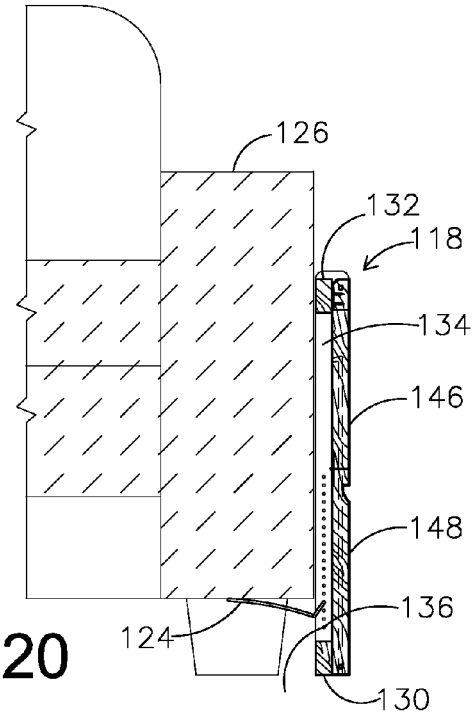
FIG. 20 is a cross-sectional end view of the embodiment of FIG. 18.
Figure 21:
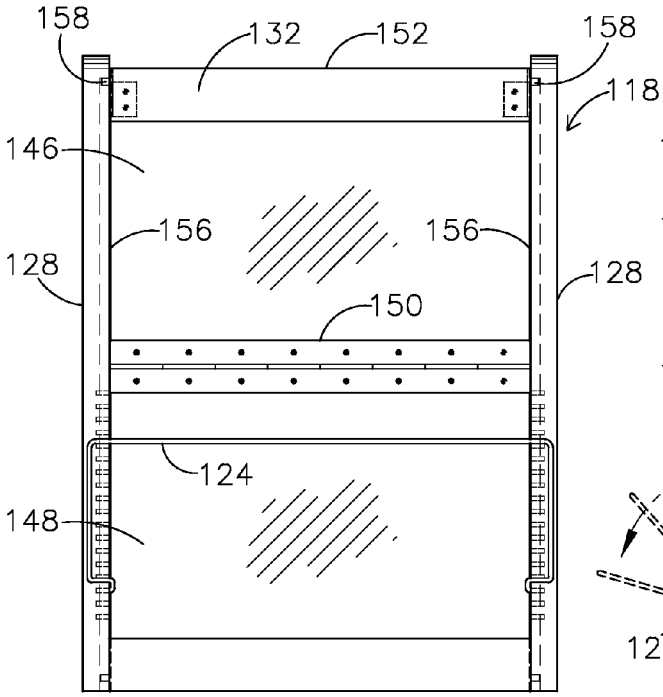
FIG. 21 is a rear view of the table assembly of FIG. 18.
Figure 23:
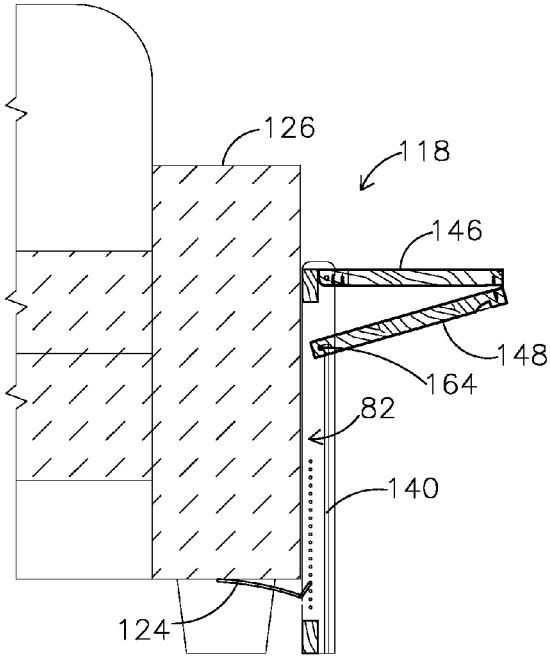
FIG. 23 is a cross-sectional end view showing the table assembly in the locked position.

Table leaf 122 is movable between a retracted position shown in FIG. 18 where main portion 146 of table leaf 122 is folded downwardly and leg portion 148 slides downwardly to the position shown in FIG. 20. Table leaf 122 is moved to the upright extended position by pivoting main portion 146 in an upward direction indicated by arrow 166 in FIG. 22 so that pins 164 extending from leg portion 148 slide upwardly along the slot 140 until the pins 164 reach the top end and slide into the horizontal latching portion 144 as shown in FIG. 23. The horizontal latching portion 144 of slot 140, pins 164 and leg portion 148 define a support mechanism for the table leaf 122 to retain the table leaf in the horizontal position. Table leaf 122 is retracted by pulling the leg portion 148 outwardly until pins 164 reach the longitudinal slot 140 and are able to slide downwardly to the retracted position shown in FIG. 20.

In the previous embodiments, the table assembly of the invention is removably coupled to a couch or chair by a spring that engages the bottom surface of the chair with sufficient force to retain the table assembly in the upright position. In the embodiments using the spring, preferably the spring is not fixed to the underside of the chair. Other mechanisms can also be used for removably attaching the table assembly to a chair or other furniture item. For example, in the embodiment of FIGS. 24 and 25, an L-shaped bracket 168 defines a coupling mechanism for the table assembly. The L-shaped bracket has a bottom leg 170 and a vertical leg 172. Bottom leg 170 can be attached to the bottom surface of a chair 174 by screws 176 or other fasteners that extend into the bottom of the chair 174. By mounting the bottom leg 170 to the bottom of the chair, the coupling mechanism can be removed from the chair without damaging the chair or damaging the appearance of the chair. The base 178 of the table assembly 180 is provided with a U-shaped bracket 182 for mating with the vertical leg 172. In the embodiment illustrated, the U-shaped bracket 182 extends in a horizontal direction with respect to the vertical leg 172 to accommodate different heights and dimensions of the chair and table assembly.

Figure 24:
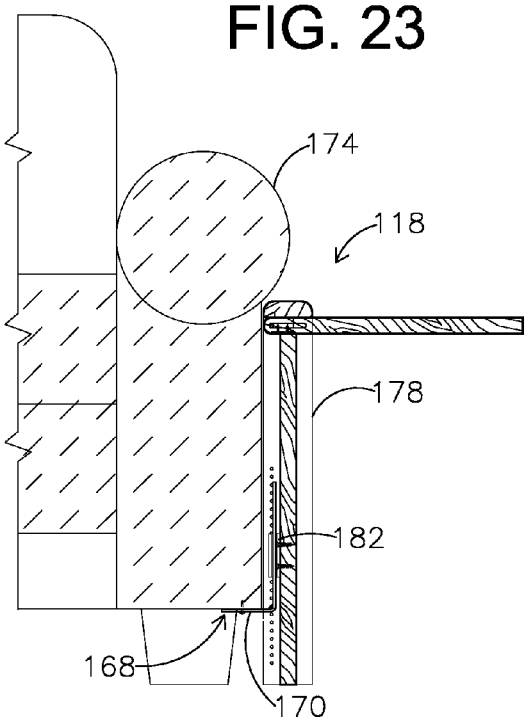
FIG. 24 is a cross-sectional end view of another embodiment showing the coupling mechanism.
Figure 25:
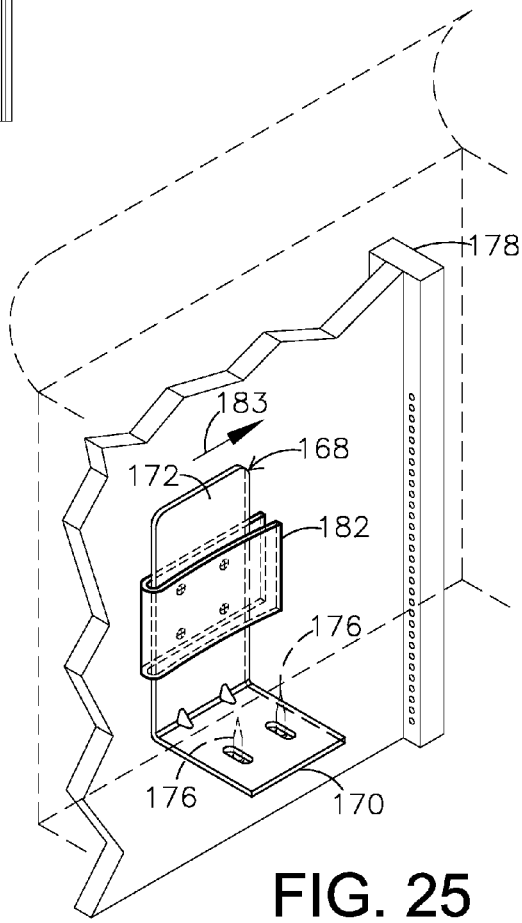
FIG. 25 is a partial perspective view of the embodiment of FIG. 24.

In the embodiment shown in FIGS. 24 and 25, a single coupling mechanism is shown. It will be understood that two or more coupling mechanisms can be included in each table assembly to provide a secure attachment of the table assembly to the chair. The table assembly 180 is coupled to the coupling mechanism by positioning the U-shaped bracket 182 above the vertical leg 172 of bracket 168 and lowering the table assembly and bracket 182 onto the leg 172 or by sliding the bracket 182 laterally onto the vertical leg 172 as indicated by the arrow 183 in FIG. 25. The table assembly is separated from the chair by lifting or sliding the table assembly upward to separate the U-shaped bracket 182 from the L-shaped bracket 168.

Figure 26:
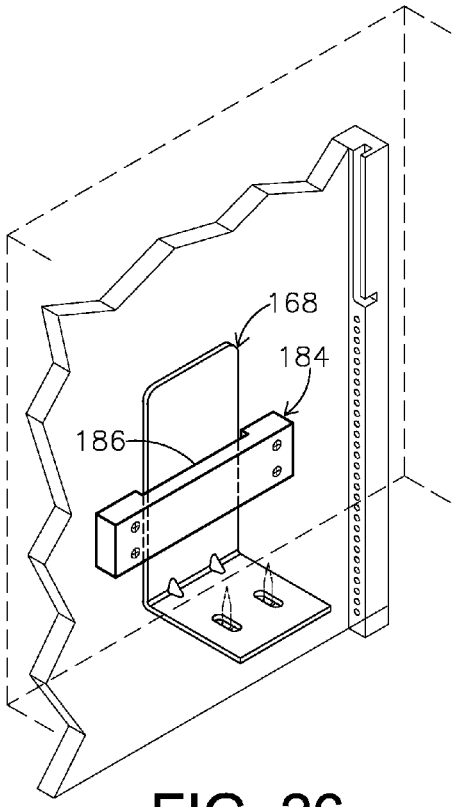
FIG. 26 is a partial perspective view of the coupling mechanism in another embodiment.
Figure 27:
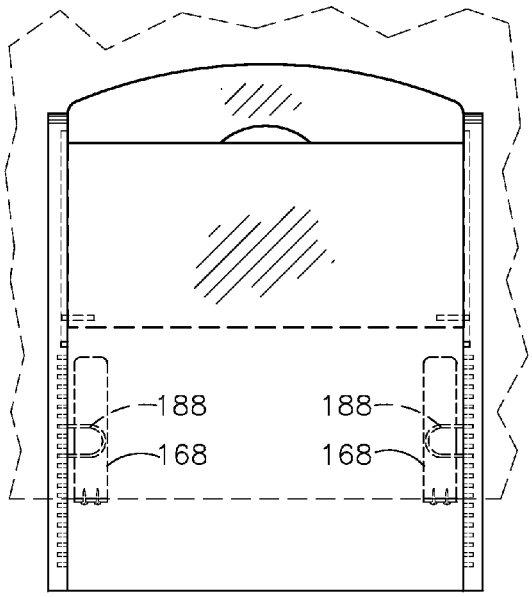
FIG. 27 is an end view of the coupling mechanism in a further embodiment.
Figure 28:
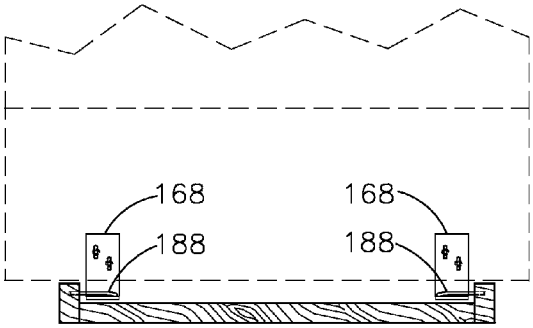
FIG. 28 is a top view of the embodiment of FIG. 27.
Figure 29:
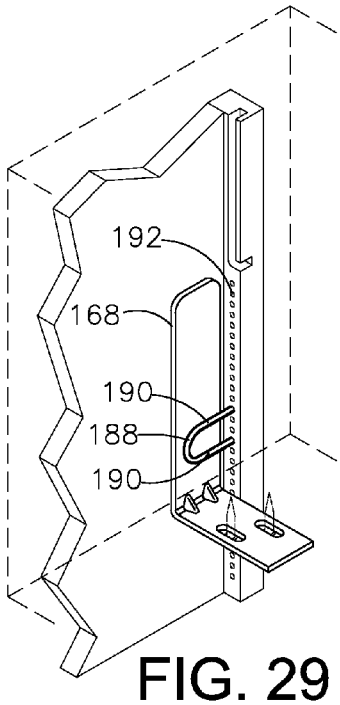
FIG. 29 is a perspective view of the embodiment of FIG. 27.
Figure 30:
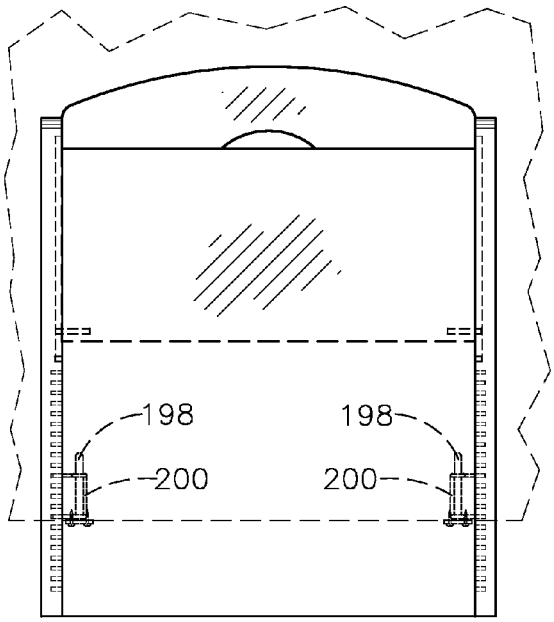
FIG. 30 is a front view of a further embodiment of the coupling mechanism.
Figure 31:
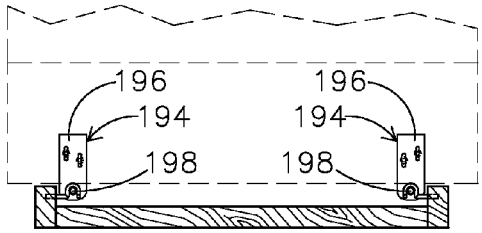
FIG. 31 is a top view of the embodiment of FIG. 30.
Figure 32:
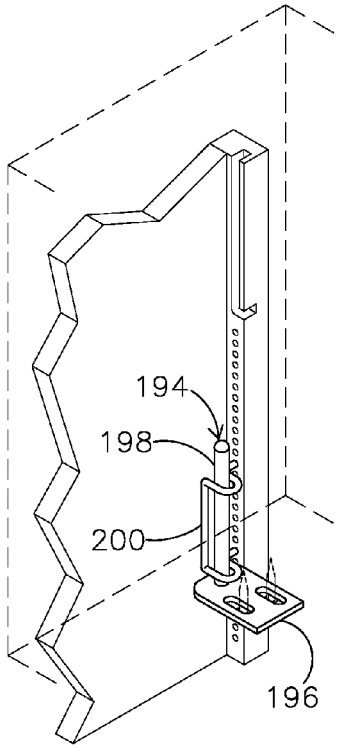
FIG. 32 is a partial perspective view of the embodiment of FIG. 30.
Figure 33:
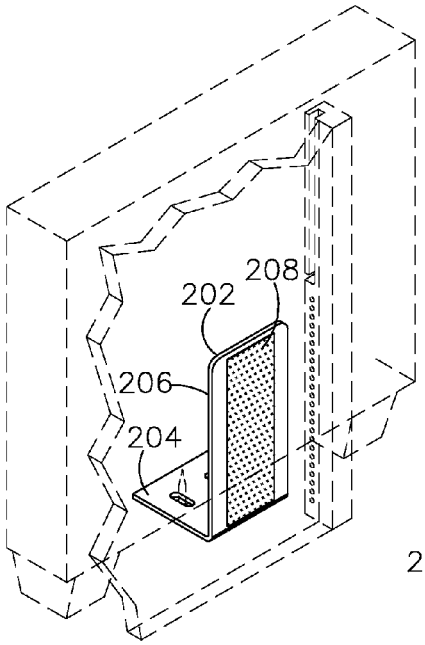
FIG. 33 is a perspective view of the coupling mechanism in another embodiment of the invention.
Figure 34:
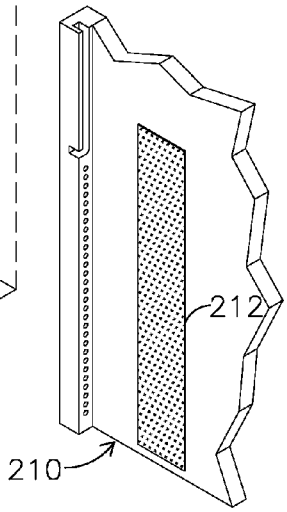
FIG. 34 is a perspective view of the rear side of the coupling mechanism of FIG. 33.

In a further embodiment shown in FIG. 26, the table assembly can include a bracket 184 having a vertically oriented slot 186 to receive the L-shaped bracket 168. In another embodiment shown in FIGS. 27-29, the inner face of the respective side rails can include a clip member 188 for engaging the L-shaped brackets 168. In the embodiment shown, clip 188 has a substantially U shape with a pair of legs 190 that are received in the holes 192. In another embodiment shown in FIG. 30-32, a bracket 194 having a bottom leg 196 is attached to the bottom surface of a chair. Bracket 194 includes an upwardly extending pin 198 that is received within a U-shaped spring clip 200 that is attached to the inner face of the side rails of the table assembly. In another embodiment shown in FIGS. 33 and 34, an L-shaped bracket 202 has a bottom leg 204 and a vertical leg 206 with an adhesive fastener 208 on the outer surface. The table assembly 210 includes corresponding adhesive fastener 212 for mating with the adhesive fastener 208 on the bracket 202. In a preferred embodiment of the invention, the adhesive fasteners 208 and 212 are a hook and pile-type fastener such as a Velcro-type fastener system. Fastener 212 alternatively can be a magnetic sheet and bracket 202 can be a metal angle.

While various embodiments have been shown to illustrate the invention, it will be understood by those skilled in the art that various changes and modifications can be made without departing from the scope of the invention as defined in the appended claims.

What is claimed is:

1. A folding table assembly comprising:

a base having a vertical dimension with a top end and a bottom floor-engaging end for supporting said base;

a table leaf coupled to said base and being movable between a retracted position lying substantially parallel to said base and an extended horizontal position substantially perpendicular to said base; and a coupling mechanism for removably coupling said base to a furniture support and retaining said base in an upright position, said coupling mechanism being spring biased in an upward direction and having a dimension to engage a bottom surface of said furniture support, thereby holding said assembly in an upright orientation.

2. The table of claim 1, wherein said base has a planar dimension defining a height and a width and having a first side facing outwardly and a second side facing inwardly toward the furniture support.

3. The table of claim 2, wherein said coupling mechanism comprises a spring having a first end coupled to said base and a second end biased in an upward direction and having a dimension to engage a bottom side of the furniture support and retain said base in an upright position.

4. The table of claim 3, wherein said first end of said spring is adjustable vertically with respect to said base.

5. The table of claim 4, wherein said first end of said spring has a pair of legs removably coupled to said base.

6. The folding table assembly of claim 4, wherein said base includes a first side and a second side, each having a plurality of spaced apart holes aligned in a vertical orientation; and said spring has two spaced-apart legs defining said first end and an arm extending from each of said legs defining said second end, said legs being receivable in one of said holes in said base to adjust the vertical position of said spring with respect to said base.

7. The table of claim 1, wherein said table leaf has a first end pivotally coupled to said base, and where said base has a mechanism for securing said table leaf in a horizontal position.

8. The table of claim 1, wherein said coupling mechanism engages the bottom surface of the furniture support to bias the base in a downward direction and to bias said top end of said base toward the furniture support.

9. A retractable table assembly for removably coupling to a furniture support, said assembly comprising:

a table base having a substantially planar configuration with a floor-engaging bottom end, an inner face, an outer face, a first side, a second side and a top end;

a table leaf coupled to said base and being movable between a retracted position substantially parallel to and against said first side of said base and an extended position substantially perpendicular to and extending outwardly from said first side of said base;

a support mechanism for retaining said table leaf in the extended position; and a coupling mechanism having a first end coupled to said base at said bottom end and a second end extending outwardly from said second side of said base, said second end of said coupling mechanism being spring biased in an upward direction to contact a bottom face of the furniture support for retaining said base in an upright position.

10. The table assembly of claim 9, wherein said table leaf has a first end pivotally coupled to said base.

11. The table assembly of claim 10, wherein said base has a first inner side and second inner side facing said first inner side, each of said inner sides having a horizontal slot, and a brace extending between said inner sides, and said first end of said table leaf having outwardly extending hinge pins received in said horizontal slot and being movable between a first end of said slots to pivot to the retracted position, and a second end where said table leaf is supported in the extended position by said brace, said slots and said hinge pins defining said support mechanism.

12. The table assembly of claim 10, wherein said base has a first inner side and an opposite second inner side, and a panel extending between said first and second inner sides, each of said inner sides having a longitudinal slot having a top end and a bottom end, and said first end of said table leaf having outwardly extending hinge pins received in said slots and being movable between the bottom end when said table leaf is retracted and said top end when said table leaf is in the extended position, said table leaf being pivotable from a vertical position to a horizontal position where said table leaf is supported in said horizontal position by said panel.

13. The table assembly of claim 10, wherein said table leaf has a first end coupled to said base about a pivot axis, and a folding brace having a first end coupled to a second end of said table leaf, said brace having a second end for coupling with said base to retain said table leaf in the extended position and defining said support mechanism.

14. The table assembly of claim 9, wherein said coupling mechanism comprises a spring having a pair of legs coupled to said base and an outer end biased in an upward direction and having a dimension to engage a bottom side of said furniture support to retain said base in an upright position.

15. The table assembly of claim 9, wherein said coupling mechanism engages the bottom face of the furniture support to bias said top end of said table base toward said furniture support and support said base in said upright position.

16. A folding table assembly comprising a furniture support having a downwardly facing bottom surface, a table base having a substantially planar configuration with a bottom floor engaging end, a top end, a first side and a second side;

a table leaf pivotally coupled to said base and being movable between a retracted position lying substantially parallel against said base and an extended position substantially perpendicular to a longitudinal dimension of said base, and a support mechanism to retain said table leaf in the extended position; and a coupling mechanism having a first end coupled to a bottom end of said base and a second end coupled to said bottom surface of said furniture support, said coupling mechanism adapted for removably coupling said base to said furniture support, said coupling mechanism comprising a spring having at least one first arm coupled to said base and at least one second arm extending from said first arm and being biased in an upward direction, said at least one second arm having a dimension to engage the bottom surface of said furniture support and retain said table base in an upright position.

17. The table assembly of claim 16, wherein said table leaf is cantilevered with respect to said base when said table leaf is in the extended position.

18. A folding table assembly comprising a furniture support having a downwardly facing bottom surface, a table base having a substantially planar configuration with a bottom floor engaging end, a first inner side, a second outer side, and a top end;

a table leaf pivotally coupled to said base and being movable between a retracted position lying substantially parallel against said base and an extended position substantially perpendicular to a longitudinal dimension of said base; and a coupling mechanism having a first coupling member fixed to said bottom surface of said furniture support and a second coupling member fixed to said floor engaging end of said table base, said first and second coupling members being removably coupled together to hold said table base in an upright position.

19. The folding table assembly of claim 18, wherein said first coupling member has a first leg coupled to said bottom surface and a second leg extending substantially perpendicular to said first leg in an upward direction, said second leg having an inner surface facing said furniture support; and said second coupling member having a surface engaging said inner surface of said second leg.

20. The folding table assembly of claim 19, wherein said second coupling member is a bracket member that hooks onto said second leg of said first coupling member.

* * * * *